US010028532B2

(12) United States Patent
Zhu

(10) Patent No.: US 10,028,532 B2
(45) Date of Patent: Jul. 24, 2018

(54) ELECTRONIC CIGARETTES HAVING SQUEEZABLE E-LIQUID TANK

(71) Applicant: Xiaochun Zhu, Guangdong (CN)

(72) Inventor: Xiaochun Zhu, Guangdong (CN)

( * ) Notice: Subject to any disclaimer, the term of this patent is extended or adjusted under 35 U.S.C. 154(b) by 1010 days.

(21) Appl. No.: 14/463,379

(22) Filed: Aug. 19, 2014

(65) Prior Publication Data

US 2015/0374039 A1 Dec. 31, 2015

Related U.S. Application Data

(63) Continuation of application No. PCT/CN2014/080861, filed on Jun. 26, 2014.

(51) Int. Cl.
*A24F 47/00* (2006.01)
*H05B 3/03* (2006.01)
*H05B 3/16* (2006.01)

(52) U.S. Cl.
CPC ..... *A24F 47/008* (2013.01); *H05B 3/03* (2013.01); *H05B 3/16* (2013.01)

(58) Field of Classification Search
None
See application file for complete search history.

(56) References Cited

U.S. PATENT DOCUMENTS

2012/0318882 A1* 12/2012 Abehasera ..... A61M 11/041 239/1
2013/0213418 A1* 8/2013 Tucker ..... A24F 47/004 131/328
2014/0261492 A1* 9/2014 Kane ..... A24F 47/008 131/328
2015/0020822 A1* 1/2015 Janardhan ..... A24F 47/008 131/328

FOREIGN PATENT DOCUMENTS

CN 1575673 A 2/2005
CN 201061259 Y 5/2008
(Continued)

OTHER PUBLICATIONS

International Search Report, dated Dec. 30, 2015.

*Primary Examiner* — Dennis R Cordray
(74) *Attorney, Agent, or Firm* — Locke Lord LLP; Tim Tingkang Xia, Esq.

(57) ABSTRACT

The present invention relates to an electronic cigarette. The electronic cigarette includes: a first tubular body forming a vaporizer chamber, a removable mouth piece disposed on the first tubular body, a vaporizer assembly disposed inside of vaporizer chamber, having a positive terminal with an e-liquid conduit hole, a negative terminal, 2 sets of e-liquid media, and 2 heating wires wound around e-liquid media, a squeezable e-liquid tank adapted for storing e-liquid with an e-liquid conduit to provide e-liquid to e-liquid media in vaporizer chamber, a second tubular body forming a squeezable e-liquid tank container; and a connecting and sealing assembly for connecting first tubular body and second tubular body. When a user squeezes the squeezable e-liquid tank to soak e-liquid media with e-liquid, user starts e-cigarette smoking by switch on a battery power source to provide electrical power heating wires 25 to vaporize e-liquid and generate e-cigarette vapor for user.

19 Claims, 4 Drawing Sheets

(56) References Cited

FOREIGN PATENT DOCUMENTS

| | | | |
|---|---|---|---|
| CN | 202445137 | U | 9/2012 |
| CN | 203341007 | U | 12/2013 |
| CN | 104068474 | A | 10/2014 |
| CN | 203969205 | U | 12/2014 |
| EP | 0254842 | A2 | 2/1988 |

* cited by examiner

ELECTRONIC CIGARETTES HAVING SQUEEZABLE E-LIQUID TANK

CROSS-REFERENCE TO RELATED APPLICATIONS

This application is a continuation in part of a PCT/CN2014/080861, filed with the State Intellectual Property Office of China on Jun. 26, 2014, entitled "Electronic Cigarettes having Squeezable E-Liquid Tank", by Xiaochun ZHU, the disclosures of which are incorporated herein in their entireties by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD

The present invention generally relates to the field of electronic cigarette (or e-cigarette), and more particularly to electronic cigarettes having squeezable e-liquid tank.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

It is well known that smoking cigarette is harmful to smoker's health. The active ingredient in a cigarette is mainly nicotine. During smoking, nicotine, along with tar aerosol droplets produced in the cigarette burning, are breathed into the alveolus and absorbed quickly by the smoker. Once nicotine is absorbed into the blood of the smoker, nicotine then produces its effect on the receptors of the smoker's central nervous system, causing the smoker relax and enjoy an inebriety similar to that produced by an exhilarant.

The electronic cigarette is sometimes referred as electronic vaporing device, personal vaporizer (PV), or electronic nicotine delivery system (ENDS). It is a battery-powered device which simulates tobacco smoking. It generally uses a heating element that vaporizes a liquid solution (e-liquid). Some solutions contain a mixture of nicotine and a variety of flavorings, while others release a flavored vapor without nicotine. Many are designed to simulate smoking experience, such as cigarette smoking or cigar smoking. Some of them are made with similar appearance, while others are made considerably different in appearance.

Conventionally, the e-liquid in the e-cigarette is stored in an e-liquid supplying reservoir. The e-liquid supplying reservoir contains various types of fibers such as cotton, polypropylene fiber, terylene fiber, or nylon filer. The e-liquid is soaked in these fibers and the liquid solution is passed through these fibers to a heating element to be vaporized.

The e-liquid is vaporized on the heating element with fibers. However, the poor contact of the fibers with heating element causes uneven vaporization. Additionally the direct contact of the fiber with heating element also causes a burning smell. It is desirable to allow liquid solution to make direct contact with the heating element without any fibers such that the liquid solution is vaporized evenly without the burning smell.

There are two type of e-cigarette: disposable e-cigarette, and refillable e-cigarette. Disposable e-cigarette is manufactured with certain amount of e-liquid in the product. When the e-liquid packed in the disposable e-cigarette is used up, it is no longer usable. The disposable e-cigarette is not refillable. On the other hand, when the e-liquid in e-liquid tank is used up, the user can refill the e-liquid so the entire e-cigarette is reusable. However, currently, the refill process is cumbersome, and difficult. With conventional fiber filled e-liquid tank, the fiber and the e-liquid in the e-liquid tank may leak out. The contact between the heating element and the e-liquid in the tank is not optimum such that a portion of the heat from the heating element is wasted, and the vaporization efficiency is low.

Therefore, heretofore unaddressed needs exist in the art to address the aforementioned deficiencies and inadequacies.

SUMMARY

In one aspect, the present invention relates to an electronic cigarette. In certain embodiments, the electronic cigarette includes: (a) a first tubular body, (b) a removable mouth piece, (c) a vaporizer assembly, (d) a squeezable e-liquid tank, (e) a second tubular body, and (f) a connecting and sealing assembly.

In certain embodiments, the first tubular body has an open lower end and a closed top end, and the first tubular body forms a vaporizer chamber. The open lower end has inside screw for connecting to another part of the electronic cigarette, and the closed top end has a mouth piece hole in the center. The removable mouth piece is disposed on the mouth piece hole of the first tubular body. The vaporizer assembly is disposed inside of the vaporizer chamber, and has: a metal positive power source terminal with an e-liquid conduit hole, a metal negative power source terminal, one or more e-liquid media, and one or more heating wires wound around the one or more e-liquid media.

In certain embodiments, the squeezable e-liquid tank has an e-liquid body and an e-liquid tank top. The squeezable e-liquid tank is used to store e-liquid for the electronic cigarette. The squeezable e-liquid tank has an e-liquid conduit in the center to provide e-liquid to the e-liquid media in the vaporizer chamber through e-liquid conduit hole. The second tubular body forms a squeezable e-liquid tank container. The squeezable e-liquid tank is placed inside of the squeezable e-liquid tank container.

In certain embodiments, the connecting and sealing assembly is used to connect the first tubular body on the top, and connect the second tubular body at the bottom. When a user squeezes the squeezable e-liquid tank to soak the one or more e-liquid media with e-liquid in the vaporizer chamber through the e-liquid conduit hole, the user starts e-cigarette smoking by switching on a battery power source to energize the heating wires to vaporize the e-liquid in the e-liquid media and generate e-cigarette vapor for the user.

In certain embodiments, the heating wires include a first heating wire and a second heating wire. The e-liquid media includes a first e-liquid medium and a second e-liquid medium. The first heating wire winds around the first e-liquid medium, and the second heating wire winds around the second e-liquid medium. Each of the two heating wires has a positive terminal connected to the metal positive power source terminal and a negative terminal connected to the metal negative power source terminal.

In one embodiment, the e-liquid conduit hole on the metal positive power source terminal has a vertical hole to connect the e-liquid conduit adapted for receiving the e-liquid from the squeezable e-liquid tank, and a horizontal hole to provide the received e-liquid to the first e-liquid medium disposed at a first end of the horizontal hole, and the second e-liquid medium disposed at a second end of the horizontal hole. The first end of the horizontal hole and the second end of the horizontal hole spray the received e-liquid onto the first e-liquid medium and the second e-liquid medium, respectively. The first e-liquid medium and the second e-liquid medium are soaked with e-liquid when the squeezable e-liquid tank is squeezed by the user, and the received e-liquid soaked in the first e-liquid medium and the second e-liquid medium is vaporized when the first heating wire and the second heating wire are energized.

In certain embodiments, the first tubular body includes a first air intake located on one side of the first tubular body, and a second air intake located on the opposite side of the first tubular body. These air intakes are used to provide air for the vaporizer chamber.

In certain embodiments, the connecting and sealing assembly includes a connecting ring, and a sealing ring. The connecting ring has an upper end, and a lower end. The connecting ring is used to connect the first tubular body through its open lower end at the upper end of the connecting ring, and connect the second tubular body at the lower end of the connecting ring. The sealing ring is used to connect the e-liquid tank top of the squeezable e-liquid tank. The sealing ring is attached to the e-liquid tank top of the squeezable e-liquid tank through a screwable connection. In certain embodiments, the sealing assembly 4 further includes a first insulation element. The first insulation element is positioned between the connecting ring and the sealing ring for providing insulation between the metal positive power source terminal and the metal negative power source terminal.

In certain embodiments, the second tubular body is attached to the connecting ring through a screwable connection at the lower end of the connecting ring. The second tubular body has a first pressing window located on one side of the second tubular body, and a second pressing window located on an opposite side of the second tubular body. The first and second pressing windows allow the user to squeeze the squeezable e-liquid tank to provide the e-liquid in the squeezable e-liquid tank to the vaporizer chamber.

In one embodiment, the e-liquid can be refilled by detaching the second tubular body from the connecting ring, and detaching the e-liquid tank top of the squeezable e-liquid tank from the sealing ring. The squeezable e-liquid tank may be refilled by injecting e-liquid into the e-liquid tank top of the squeezable e-liquid tank. In another embodiment, the squeezable e-liquid tank is a disposable e-liquid tank, and the e-liquid may be refilled by replacing the disposable e-liquid tank.

In certain embodiments, a tubular e-liquid tank support is provided between the second tubular body and the squeezable e-liquid tank. The tubular e-liquid tank support includes a first pressing window cutout located on one side of the tubular e-liquid tank support corresponding to the first pressing window, and a second pressing window cutout located on the opposite side of the tubular e-liquid tank support corresponding to the second pressing window.

In certain embodiments, the electronic cigarette further includes a first electrical terminal ring, a second electrical terminal, and a second insulation element. The first electrical terminal ring is located at a lower end of the second tubular body. The second electrical terminal is located inside of the first electrical terminal ring and electrically connected to the tubular e-liquid tank support. The second insulation element is disposed between the first electrical terminal ring and the second electrical terminal to provide insulation between the first electrical terminal ring and the second electrical terminal. The electronic cigarette further includes a sealing gasket disposed between the vaporizer assembly and the squeezable e-liquid tank.

In certain embodiments, a DC power supply is electrically connected to the electronic cigarette through the first electrical terminal ring and the second electrical terminal using a two terminal connector screwed on the first electrical terminal ring. The positive terminal of the DC power supply is electrically connected to the second electrical terminal, and the negative terminal of the DC power supply is electrically connected to the first electrical terminal ring. The first electrical terminal ring is also electrically connected to the metal negative power source terminal through the second tubular body, the connecting ring, and the first tubular body. The second electrical terminal is also electrically connected to the metal positive power source terminal through the tubular e-liquid tank support and the sealing ring.

In certain embodiments, the e-liquid media includes at least one of cotton, organic cotton, ceramic bar, polypropylene fiber, terylen fiber, and nylon fiber. The squeezable e-liquid tank is made of at least one of soft plastic, polyethylene (PE), high-density polyethylene (HDPE), low-density polyethylene (LDPE), polyethylene terephthalate (PETE), flexible polyvinyl chloride (PVC), polypropylene (PP), and polystyrene (PS). The first tubular body, the connecting ring, and the second tubular body are made of metal, and when the first tubular body, the connecting ring, and the second tubular body are connected together, the first tubular body, the connecting ring, and the second tubular body are made of metal conduct electricity.

These and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present invention to the specific embodiments disclosed and described herein. The drawings are not necessarily to scale, emphasis instead being placed upon clearly illustrating the principles of the invention, and wherein.

DETAILED DESCRIPTION

Figure 1:
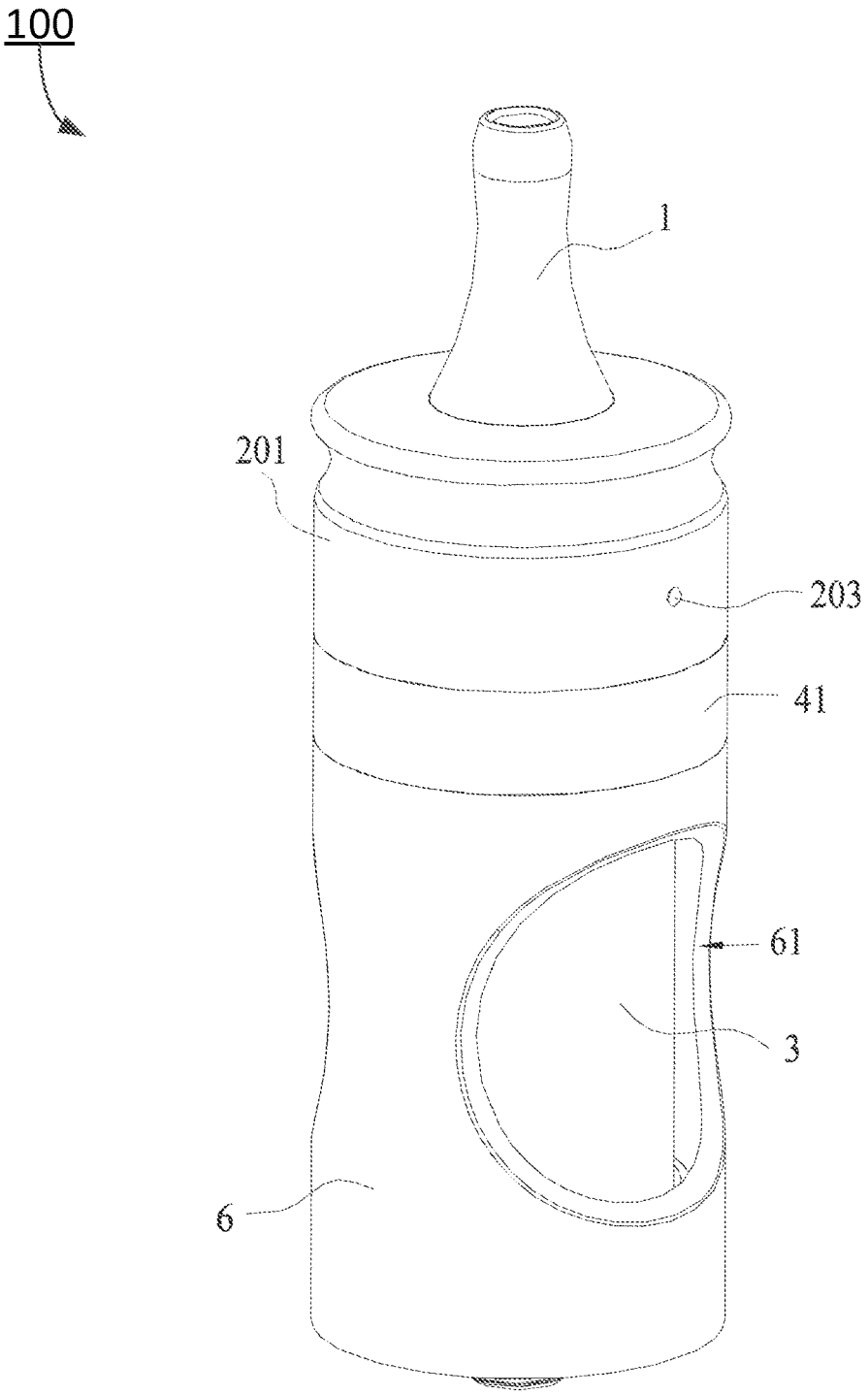
FIG. 1 is a perspective view of an e-cigarette having a squeezable e-liquid tank according to one embodiment of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

The description will be made as to the embodiments of the present invention in conjunction with the accompanying drawings FIGS. 1 through 4. In accordance with the purposes of this invention, as embodied and broadly described herein, this invention, in one aspect, relates to an electronic cigarette having a squeezable e-liquid tank.

Many specific details are provided in the following descriptions to make the present invention be fully understood, but the present invention may also be implemented by using other manners different from those described herein, so that the present invention is not limited by the specific embodiments disclosed in the following.

Figure 2:
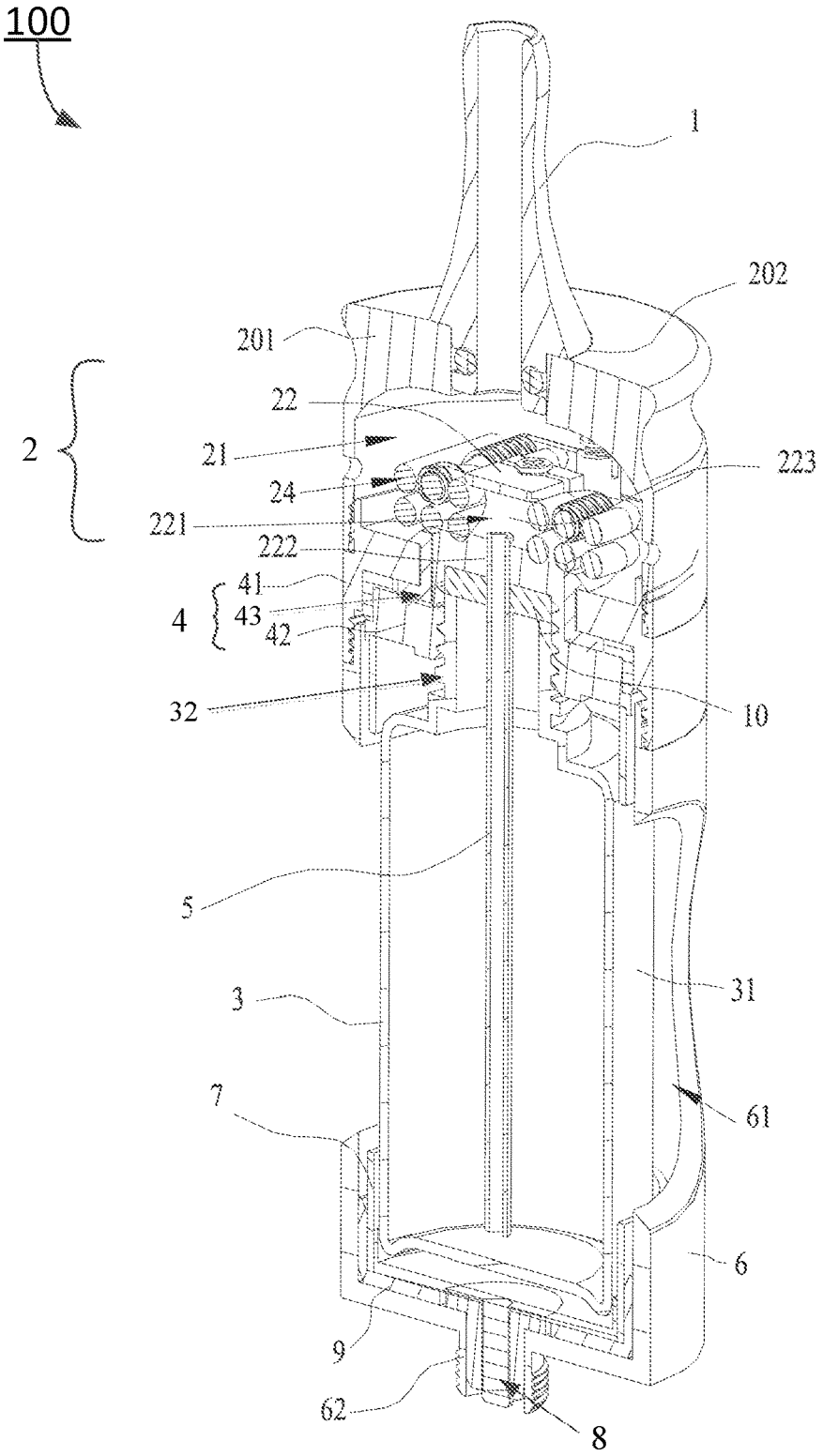
FIG. 2 shows a perspective cross sectional view of the e-cigarette in FIG. 1 according to one embodiment of the present invention.
Figure 3:
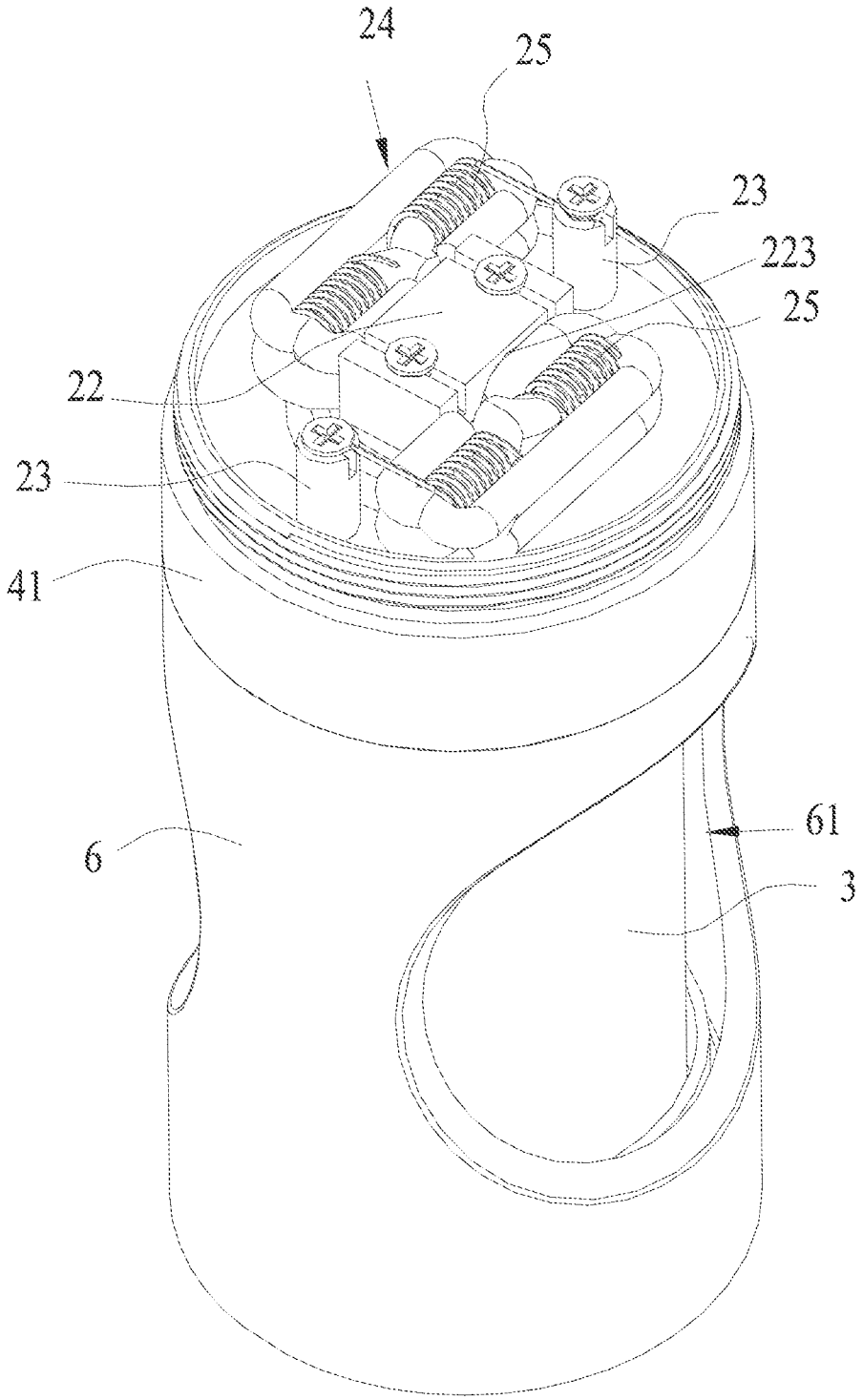
FIG. 3 shows a partial perspective view of the e-cigarette showing a vaporizer chamber with a first tubular body removed and the squeezable e-liquid tank according to one embodiment of the present invention.

Referring now to FIGS. 1-3, a perspective view of an e-cigarette 100 having a squeezable e-liquid tank, a perspective cross sectional view of the e-cigarette, and a partial perspective view of the e-cigarette showing the squeezable e-liquid tank and a vaporizer chamber with a first tubular body removed are shown according to certain embodiments of the present invention.

In certain embodiments, the electronic cigarette 100 includes: (a) a first tubular body 201, (b) a removable mouth piece 1, (c) a vaporizer assembly 2, (d) a squeezable e-liquid tank 3, (e) a second tubular body 6, and (f) a connecting and sealing assembly 4.

In certain embodiments, the first tubular body 201 has an open lower end and a closed top end, and the first tubular body 201 forms a vaporizer chamber 21. The open lower end has inside screw for connecting to another part of the electronic cigarette 100, and the closed top end has a mouth piece hole 202 in the center. The removable mouth piece 1 is disposed on the mouth piece hole 202 of the first tubular body 201. The vaporizer assembly 2 is disposed inside of the vaporizer chamber 21, and has: a metal positive power source terminal 22 with an e-liquid conduit hole 221, a metal negative power source terminal 23, one or more e-liquid media 24, and one or more heating wires 25 wound around the one or more e-liquid media 24.

In certain embodiments, the squeezable e-liquid tank 3 has an e-liquid body 31 and an e-liquid tank top 32. The squeezable e-liquid tank 3 is used to store e-liquid for the electronic cigarette 100. When the e-liquid in the squeezable e-liquid tank 3 is used up, the squeezable e-liquid tank 3 can be refilled, or replaced so that the electronic cigarette 100 is no longer disposable, and can be reused after the squeezable e-liquid tank 3 is refilled or replaced. The squeezable e-liquid tank 3 has an e-liquid conduit 5 in the center to provide e-liquid to the e-liquid media 24 in the vaporizer chamber 21 through e-liquid conduit hole 221. The second tubular body 6 forms a squeezable e-liquid tank container. The squeezable e-liquid tank 3 is placed inside of the squeezable e-liquid tank container. The electronic cigarette 100 further includes a sealing gasket 10 disposed between the vaporizer assembly 2 and the squeezable e-liquid tank 3.

In certain embodiments, the connecting and sealing assembly 4 is used to connect the first tubular body on the top, and connect the second tubular body at the bottom. When a user squeezes the squeezable e-liquid tank 3 to soak the one or more e-liquid media with e-liquid in the vaporizer chamber through the e-liquid conduit hole, the user starts e-cigarette smoking by switching on a battery power source to energize the heating wires 25 to vaporize the e-liquid in the e-liquid media and generate e-cigarette vapor for the user.

In certain embodiments, the heating wires 25 includes a first heating wire 25 and a second heating wire 25. The e-liquid media 24 includes a first e-liquid medium 24 and a second e-liquid medium 24. The first heating wire 25 winds around the first e-liquid medium 24, and the second heating wire 25 winds around the second e-liquid medium 24. Each of the two heating wires 25 has a positive terminal connected to the metal positive power source terminal 22 and a negative terminal connected to the metal negative power source terminal 23.

In one embodiment, the e-liquid conduit hole 221 on the metal positive power source terminal 22 has a vertical hole 222 to connect the e-liquid conduit 5 adapted for receiving the e-liquid from the squeezable e-liquid tank 3, and a horizontal hole 223 to provide the received e-liquid to the first e-liquid medium 24 disposed at a first end of the horizontal hole 223, and the second e-liquid medium 24 disposed at a second end of the horizontal hole 223. The first end of the horizontal hole 223 and the second end of the horizontal hole 223 spray the received e-liquid onto the first e-liquid medium 24 and the second e-liquid medium 24, respectively. The first e-liquid medium 24 and the second e-liquid medium 24 are soaked with e-liquid when the squeezable e-liquid tank 3 is squeezed by the user, and the received e-liquid soaked in the first e-liquid medium 24 and the second e-liquid medium 24 is vaporized when the first heating wire 25 and the second heating wire 25 are energized. The first e-liquid medium 24 and the second e-liquid medium 24 are in fully contact with the first heating wire 25 and the second heating wire 25, respectively. The heat transfer efficiency of such dual heating cores is improved, and heat dissipation is reduced.

In certain embodiments, the first tubular body 201 includes a first air intake 203 located on one side of the first tubular body 201, and a second air intake 203 located on the opposite side of the first tubular body 201. These air intakes 203 are used to provide air for the vaporizer chamber 21. When the e-liquid soaked on the e-liquid media 24 is heated by the heating wires 25, the e-liquid is vaporized by the heat generated by the heating wires 25, and the user can suck up the vapor through the removable mouth piece 1 to simulate the cigarette smoking. The electronic cigarette 100 described here is very easy to use and its vaporizing efficiency is higher than the conventional electronic cigarettes.

In certain embodiments, the connecting and sealing assembly 4 includes a connecting ring 41, and a sealing ring 42. The connecting ring 41 has an upper end, and a lower end. The connecting ring 41 is used to connect the first tubular body 201 through its open lower end at the upper end of the connecting ring 41, and connect the second tubular body 6 at the lower end of the connecting ring 41. The sealing ring 42 is used to connect the e-liquid tank top 32 of the squeezable e-liquid tank 3. The sealing ring 42 is attached to the e-liquid tank top 32 of the squeezable e-liquid tank 3 through a screwable connection. In certain embodiments, the sealing assembly 4 further includes a first insulation element 43. The first insulation element 43 is positioned between the connecting ring 41 and the sealing ring 42 for providing insulation between the metal positive power source terminal 22 and the metal negative power source terminal 23.

In certain embodiments, the second tubular body 6 is attached to the connecting ring 41 through a screwable connection at the lower end of the connecting ring 41. The second tubular body 6 has a first pressing window 61 located on one side of the second tubular body 6, and a second pressing window 61 located on an opposite side of the second tubular body 6. The first and second pressing windows 61 allow the user to squeeze the squeezable e-liquid tank 3 to provide the e-liquid in the squeezable e-liquid tank 3 to the vaporizer chamber 21.

In one embodiment, the e-liquid can be refilled by detaching the second tubular body 6 from the connecting ring 41, and detaching the e-liquid tank top 32 of the squeezable e-liquid tank 3 from the sealing ring 42. The squeezable e-liquid tank 3 may be refilled by injecting e-liquid into the e-liquid tank top 32 of the squeezable e-liquid tank 3. In another embodiment, the squeezable e-liquid tank 3 is a disposable e-liquid tank, and the e-liquid may be refilled by replacing the disposable e-liquid tank. The user can select e-liquid in different flavors, and it is very easy to refill or replace the e-liquid in the squeezable e-liquid tank 3.

Figure 4:
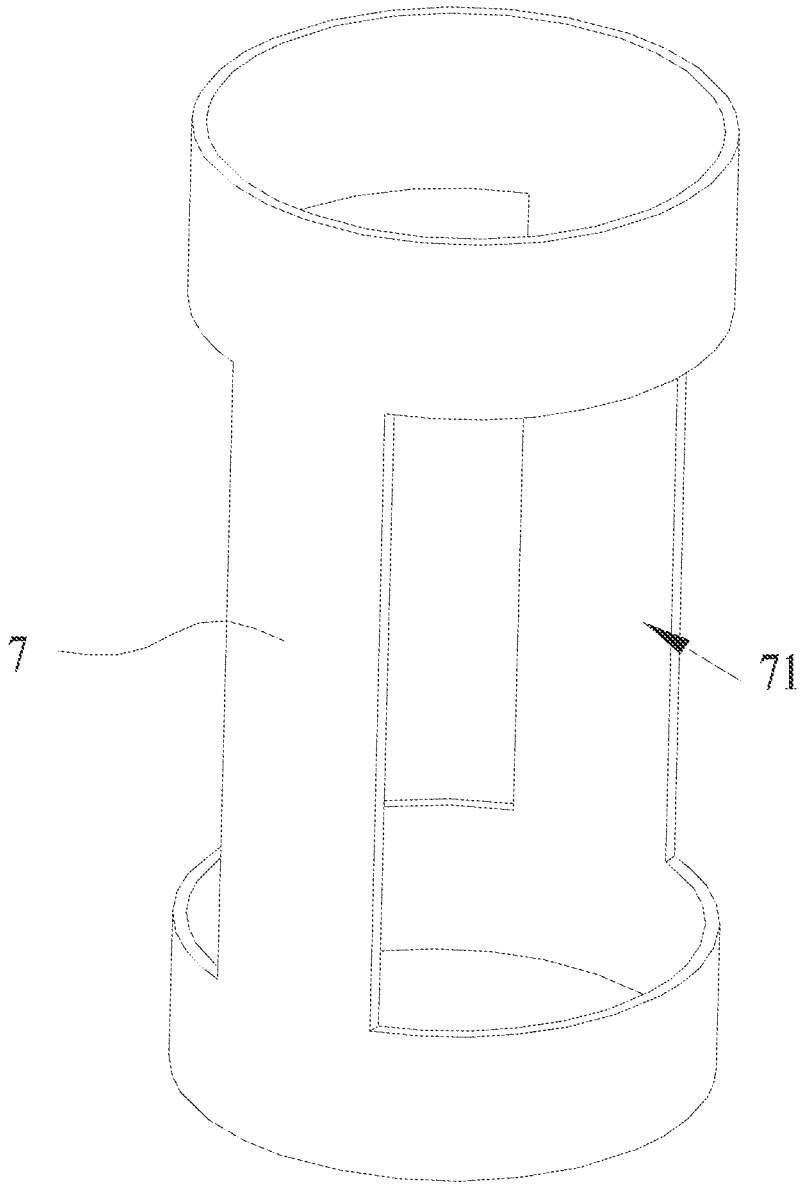
FIG. 4 shows a perspective view of a tubular e-liquid tank support according to another embodiment of the present invention.

Referring now to FIG. 2 and FIG. 4, in certain embodiments, a tubular e-liquid tank support 7 is provided between the second tubular body 6 and the squeezable e-liquid tank 3. The tubular e-liquid tank support 7 includes a first pressing window cutout 71 located on one side of the tubular e-liquid tank support 7 corresponding to the first pressing window 61, and a second pressing window cutout 71 located on the opposite side of the tubular e-liquid tank support 7 corresponding to the second pressing window 61.

In certain embodiments, the electronic cigarette 100 further includes a first electrical terminal ring 62, a second electrical terminal 8, and a second insulation element 9. The first electrical terminal ring 62 is located at a lower end of the second tubular body 6. The second electrical terminal 8 is located inside of the first electrical terminal ring 62 and electrically connected to the tubular e-liquid tank support 7. The second insulation element 9 is disposed between the first electrical terminal ring 62 and the second electrical terminal 8 to provide insulation between the first electrical terminal ring 62 and the second electrical terminal 8.

In certain embodiments, a DC power supply is electrically connected to the electronic cigarette through the first electrical terminal ring 62 and the second electrical terminal 8 using a two terminal connector screwed on the first electrical terminal ring 62. The positive terminal of the DC power supply is electrically connected to the second electrical terminal 8, and the negative terminal of the DC power supply is electrically connected to the first electrical terminal ring 62. The first electrical terminal ring 62 is also electrically connected to the metal negative power source terminal 23 through the second tubular body 6, the connecting ring 41, and the first tubular body 201. The second electrical terminal 8 is also electrically connected to the metal positive power source terminal 22 through the tubular e-liquid tank support 7 and the sealing ring 42.

In certain embodiments, the e-liquid media 24 includes at least one of cotton, organic cotton, ceramic bar, polypropylene fiber, terylen fiber, and nylon fiber. The squeezable e-liquid tank 3 is made of at least one of soft plastic, polyethylene (PE), high-density polyethylene (HDPE), low-density polyethylene (LDPE), polyethylene terephthalate (PETE), flexible polyvinyl chloride (PVC), polypropylene (PP), and polystyrene (PS). The first tubular body 201, the connecting ring 41, and the second tubular body 6 are made of metal, and when the first tubular body 201, the connecting ring 41, and the second tubular body 6 are connected together, the first tubular body 201, the connecting ring 41, and the second tubular body 6 are made of metal conduct electricity.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims, the foregoing description and the exemplary embodiments described therein, and accompanying drawings.

What is claimed is:

1. An electronic cigarette, comprising:

a first tubular body forming a vaporizer chamber having an open lower end, and a sealed top end with a mouth piece hole in the center;

a removable mouth piece disposed on the mouth piece hole of the first tubular body;

a vaporizer assembly disposed inside of the vaporizer chamber, having a metal positive power source terminal with an e-liquid conduit hole, a metal negative power source terminal, a plurality of e-liquid media, and a plurality of heating wires wound around the plurality of e-liquid media;

a squeezable e-liquid tank having an e-liquid body and an e-liquid tank top, adapted for storing e-liquid, wherein the squeezable e-liquid tank has an e-liquid conduit to provide e-liquid to the plurality of e-liquid media in the vaporizer chamber through the e-liquid conduit hole, and wherein the e-liquid tank top has a screw thread formed on an outer surface of the e-liquid tank top;

a second tubular body forming a squeezable e-liquid tank container; and a connecting and sealing assembly adapted for connecting the first tubular body and the second tubular body longitudinally so as to have a common axis, wherein after a user squeezes the squeezable e-liquid tank to soak the plurality of e-liquid media with e-liquid in the vaporizer chamber through the e-liquid conduit hole, the user starts e-cigarette smoking by energizing the plurality of heating wires to vaporize the e-liquid in the plurality of e-liquid media and generate e-cigarette vapor for the user.

2. The electronic cigarette of claim 1, wherein the plurality of heating wires comprises a first heating wire and a second heating wire, the plurality of e-liquid media comprises a first e-liquid medium and a second e-liquid medium, the first heating wire winds around the first e-liquid medium, the second heating wire winds around the second e-liquid medium, and each of the two heating wires has a positive terminal connected to the metal positive power source terminal and a negative terminal connected to the metal negative power source terminal.

3. The electronic cigarette of claim 2, wherein the e-liquid conduit hole comprises a vertical hole to connect the e-liquid conduit adapted for receiving the e-liquid from the squeezable e-liquid tank, and a horizontal hole having a first end and a second end to provide the received e-liquid to the first e-liquid medium disposed at the first end of the horizontal hole, and the second e-liquid medium disposed at the second end of the horizontal hole, wherein the vertical hole is defined at an upper end of the e-liquid conduit along the common axis, and the horizontal hole is defined perpendicular to the common axis and in fluid communication with the vertical hole.

4. The electronic cigarette of claim 3, wherein the first end of the horizontal hole and the second end of the horizontal hole spray e-liquid onto the first e-liquid medium and the second e-liquid medium, respectively, such that the first e-liquid medium and the second e-liquid medium are soaked with e-liquid when the squeezable e-liquid tank is squeezed by the user, and the e-liquid soaked in the first e-liquid medium and the second e-liquid medium is vaporized when the first heating wire and the second heating wire are energized.

5. The electronic cigarette of claim 1, wherein the first tubular body includes a first air intake located on one side of the first tubular body, and a second air intake located on the opposite side of the first tubular body.

6. The electronic cigarette of claim 1 further comprising a sealing gasket disposed between the vaporizer assembly and the squeezable e-liquid tank.

7. The electronic cigarette of claim 1, wherein the connecting and sealing assembly comprises a connecting ring adapted for connecting the first tubular body and the second tubular body, and a sealing ring disposed inside the connecting ring and adapted for sealing the e-liquid tank top of the squeezable e-liquid tank, wherein the connecting ring has an upper end and a lower end, and wherein, as assembled, the upper end of the connecting ring is connected to the open lower end of the first tubular body, and the lower end of the connecting ring is connected to an upper end of the second tubular body.

8. The electronic cigarette of claim 7, wherein the sealing ring is attached to the e-liquid tank top of the squeezable e-liquid tank through the screw thread on the outer surface of the e-liquid tank top.

9. The electronic cigarette of claim 7, wherein the first tubular body, the connecting ring, and the second tubular body are made of metal, and the first tubular body, the connecting ring, and the second tubular body are connected together to conduct electricity.

10. The electronic cigarette of claim 8, wherein the connecting and sealing assembly further comprises a first insulation element disposed between the connecting ring and the sealing ring.

11. The electronic cigarette of claim 10, wherein the second tubular body is attached to the connecting ring through a screw connection at the lower end of the connecting ring, and the second tubular body comprises a first pressing window located on one side of the second tubular body, and a second pressing window located on an opposite side of the second tubular body, wherein the first and second pressing windows allow the user to squeeze the squeezable e-liquid tank.

12. The electronic cigarette of claim 11, wherein the squeezable e-liquid tank is operably refilled by detaching the second tubular body from the connecting ring, and detaching the e-liquid tank top of the squeezable e-liquid tank from the sealing ring.

13. The electronic cigarette of claim 11, wherein a tubular e-liquid tank support is provided between the second tubular body and the squeezable e-liquid tank, and the tubular e-liquid tank support comprises a first pressing window cutout located on one side of the tubular e-liquid tank support corresponding to the first pressing window, and a second pressing window cutout located on the opposite side of the tubular e-liquid tank support corresponding to the second pressing window.

14. The electronic cigarette of claim 13 further comprising:

a first electrical terminal ring located at a lower end of the second tubular body, a second electrical terminal located inside of the first electrical terminal ring and electrically connected to the tubular e-liquid tank support; and a second insulation element disposed between the first electrical terminal ring and the second electrical terminal to provide insulation between the first electrical terminal ring and the second electrical terminal.

15. The electronic cigarette of claim 14, wherein the first electrical terminal ring is electrically connected to the metal negative power source terminal through the second tubular body, the connecting ring, and the first tubular body, and the second electrical terminal is electrically connected to the metal positive power source terminal through the tubular e-liquid tank support and the sealing ring.

16. The electronic cigarette of claim 1, wherein the plurality of e-liquid media comprises at least one of cotton, organic cotton, ceramic bar, polypropylene fiber, terylen fiber, and nylon fiber.

17. The electronic cigarette of claim 1, wherein the squeezable e-liquid tank is operably refilled by injecting e-liquid into the e-liquid tank top of the squeezable e-liquid tank.

18. The electronic cigarette of claim 1, wherein the squeezable e-liquid tank is made of at least one of soft plastic, polyethylene (PE), high-density polyethylene (HDPE), low-density polyethylene (LDPE), polyethylene terephthalate (PETE), flexible polyvinyl chloride (PVC), polypropylene (PP), and polystyrene (PS).

19. The electronic cigarette of claim 1, wherein the squeezable e-liquid tank comprises a disposable e-liquid tank, and the e-liquid is operably refilled by replacing the disposable e-liquid tank.

* * * * *